United States Patent [19]

Tauschek et al.

[11] 4,075,987

[45] Feb. 28, 1978

[54] VALVE ROTATOR

[75] Inventors: Max J. Tauschek, South Euclid; William A. Michaels, Seven Hills, both of Ohio

[73] Assignee: TRW Inc., Cleveland, Ohio

[21] Appl. No.: 570,749

[22] Filed: Apr. 23, 1975

[51] Int. Cl.[2] ..... F01L 1/32

[52] U.S. Cl. ..... 123/90.3; 123/90.28

[58] Field of Search ..... 123/90.28, 90.29, 90.3

[56] References Cited

U.S. PATENT DOCUMENTS

| | | | |
|---|---|---|---|
| 2,397,502 | 4/1946 | Ralston | 123/90.3 |
| 2,582,060 | 1/1952 | Newton | 123/90.3 |
| 2,624,323 | 1/1953 | Thorne | 123/90.3 |
| 2,662,511 | 12/1953 | Sward | 123/90.3 |
| 2,686,508 | 8/1954 | Ralston | 123/90.3 |
| 2,775,232 | 12/1956 | Witzky | 123/90.3 |
| 2,827,886 | 3/1958 | Geer | 123/90.3 |
| 2,875,740 | 3/1959 | Leake | 123/90.3 |
| 2,935,058 | 5/1960 | Dooley | 123/90.3 |
| 3,710,768 | 1/1973 | May | 123/90.3 |
| 3,890,943 | 6/1975 | Schonlau | 123/90.3 |

*Primary Examiner*—Charles J. Myhre
*Assistant Examiner*—Daniel J. O'Connor

[57] ABSTRACT

An improved valve rotator includes a plurality of biasing springs which are effective to urge associated balls toward the shallow ends of ramps formed between a pair of housing members. The total force applied against the balls by the biasing springs is sufficient to hold the housing members apart against the influence of a valve spring when the valve is in a closed position. Upon movement of the valve toward an open position, the valve spring force increases to a magnitude sufficient to cause the balls to move down the associated ramps against the influence of the biasing springs. As the balls move down the ramps, rotational movement of the balls causes one of the housing members to rotate relative to the other with a resulting rotation of the valve as it opens. As the valve subsequently moves toward the closed position, the valve spring force decreases and the ball biasing springs are effective to move the balls up the ramps to separate the two housing members against the influence of the valve spring. The separating movement between the two housing members is in a direction in which the valve is closed so that the separating movement promotes the closing of the valve. To prevent reverse rotation of the valve as it is closed, a one-way clutch arrangement is utilized to inhibit relative rotation between the housing members as they separate and the balls move up the ramps.

6 Claims, 9 Drawing Figures

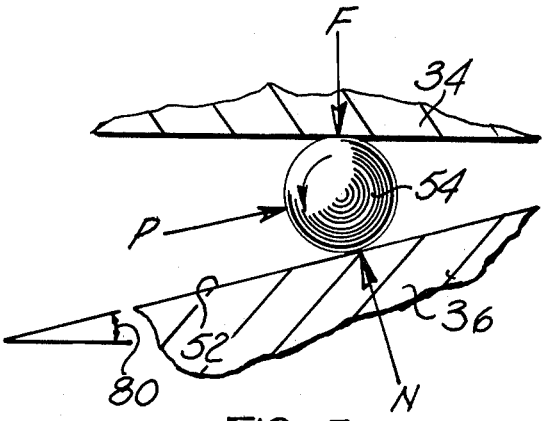
FIG. 5
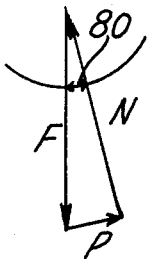
FIG. 6
FIG. 7
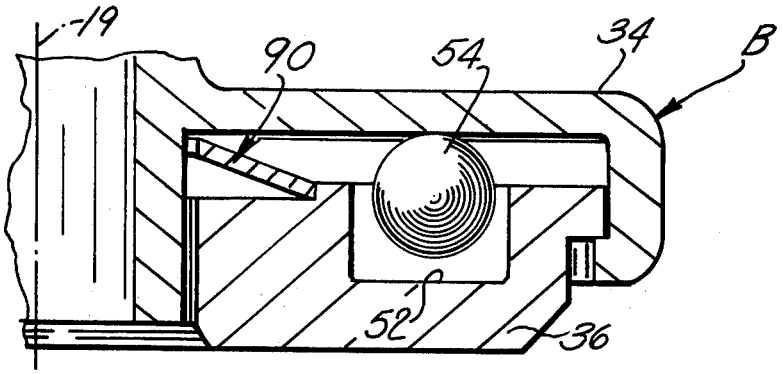
FIG. 8
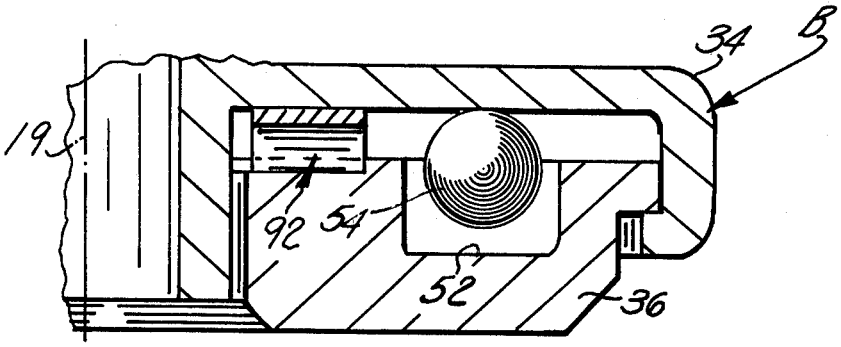
FIG. 9
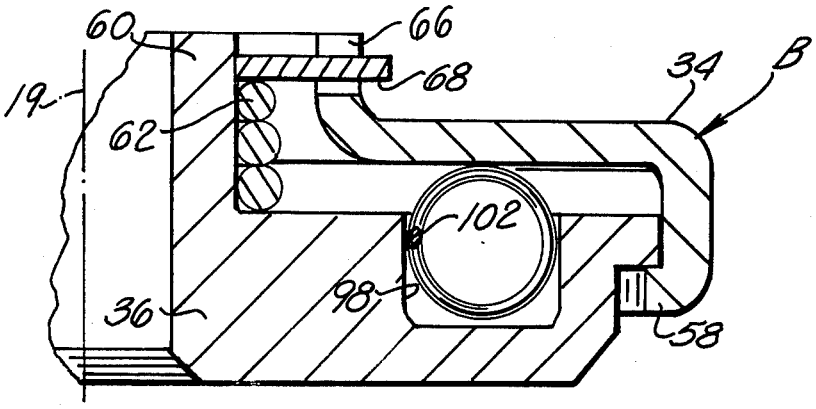

VALVE ROTATOR

BACKGROUND OF THE INVENTION

This application pertains to motion converting mechanisms, and more particularly, to mechanisms which rotate reciprocating valves on internal combustion engines.

It is common to rotate exhaust valves in internal combustion engines for reducing burning, deposit build-up and high stresses. One well known type of valve rotator is described in U.S. Pat. No. 2,624,323 issued Jan. 6, 1953, to Thorne. In the Thorne device, a pair of flanges or housing members are movable relative to each other axially and rotatably. Shiftable balls are provided between the flanges to impart rotation to one flange relative to the other during axial movement of the flanges toward each other. The rotatable flange is secured to the valve stem to rotate the valve. The valve is normally biased to a closed position by a valve spring which also acts against one of the flanges to urge it toward the other flange. When the valve is closed, the two flanges must be held axially separated from one another so that they will subsequently move toward one another upon opening of the valve. In the Thorne device, a belleville spring washer or other biasing means separate from the shiftable balls provides the biasing force necessary to hold the two parts away from each other when the valve is closed. When the valve opens, the force applied by the valve spring increases and overcomes the separating force of the belleville spring so that the two parts move toward one another and the balls to impart rotation to one of the flanges as the balls move along ramps between the flanges.

In another known valve rotator, such as shown in U.S. Pat. No. 2,758,583 issued Aug. 14, 1956, to Norton, a coil spring is positioned between two flanges. The coils of the spring are deflected when the flanges move toward one another to provide relative rotation between the flanges. In this rotator, a separate belleville spring or other separate biasing means is also used to hold the parts separated from one another when the valve is closed.

Valve rotators which do not utilize belleville spring washers or other separate biasing elements to separate the two flanges are disclosed in U.S. Pat. Nos. 2,775,232; 2,875,740; and 2,935,058. These patents are concerned with devices which will rotate a valve and/or maintain a constant force between a rocker arm and valve stem to prevent noise. In these devices, balls disposed between a pair of flanges are urged toward the shallow portions of ramps by springs. These springs are relatively weak and cannot apply a large enough force against the balls to overcome the valve spring which urges the valve closed. If the ball biasing springs were strong enough to overcome the valve spring, the flanges would separate and the valve would be forced to open slightly.

SUMMARY OF THE INVENTION

A valve rotator constructed in accordance with the present invention includes movable members, such as balls, which move along ramps in one direction to effect relative rotation between a pair of housing members or flanges and are biased in an opposite direction by springs to provide a separating force on the two flanges. The magnitude of the force imparted to the movable members or balls by the springs is sufficient to overcome the effect of a valve spring when the valve is closed and is insufficient to overcome the effect of the valve spring when the valve is open. Thus, the separating force imparted to the two flanges by the movable members or balls is greater than the force of the valve spring when the valve is in the closed position and is less than the force of the valve spring when the valve is in the open position.

In accordance with one of the important features of the invention, a rotation inhibiting means is provided between the two elements or flanges to inhibit reverse relative rotation therebetween so that a net positive rotation is achieved. This rotation inhibiting means may take many forms, including a very light friction belleville spring, a wave washer or a torsion spring clutch.

It is an object of the present invention to provide a valve rotator which has movable members, such as balls, which are urged toward the shallow portion of a ramp with sufficient force to overcome the influence of a valve spring when the valve is closed, the force on the movable members being sufficient to overcome the valve spring when the valve is open.

Another object of the invention is to provide a valve rotator with a one-way clutch which enables a valve to be rotated in one direction and prevents rotation of the valve in the opposite direction.

BRIEF DESCRIPTION OF THE DRAWINGS

Other objects and advantages will be apparent to those skilled in the art from the following description and the accompanying drawings.

FIG. 5 is a diagrammatic view showing forces applied to shiftable elements used in the rotator of the present invention;

FIG. 6 is a force diagram of the forces of FIG. 5;

FIG. 7 is a partial cross-sectional elevational view similar to FIG. 3 and showing a spring washer which is used as a rotation inhibiting means;

FIG. 8 is a partial cross-sectional elevational view similar to FIG. 7 and showing a wave spring used as a rotation inhibiting means; and FIG. 9 is a view similar to FIG. 3 showing another embodiment of the invention.

DESCRIPTION OF SPECIFIC PREFERRED EMBODIMENTS OF THE INVENTION

Figure 1:
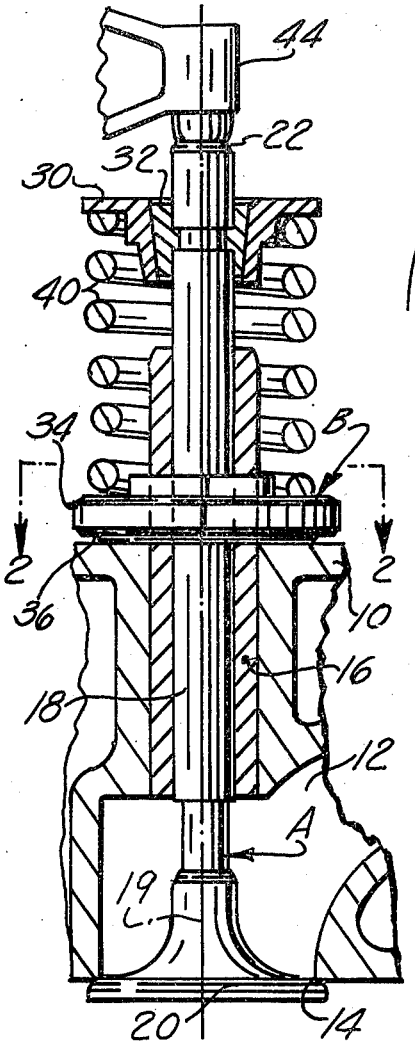
FIG. 1 is a partial cross-sectional elevational view of a valve having the improved rotator of the present invention.

With reference to the drawings, wherein the showings are for purposes of illustrating preferred embodiments of the invention only and not for puposes of limiting same, FIG. 1 shows cylinder head 10 of an internal combustion engine having an exhaust port 12 leading from a combustion chamber which is not shown. Gases flow from the combustion chamber through an opening surrounded by a valve seat 14 to exhaust port 12.

A suitable bore in cylinder head 10 has an elongated valve guide sleeve 16 secured therein for reciprocatingly and rotatably receiving stem 18 of valve A for movement along and about longitudinal axis 19. Valve A has a head 20 cooperable with valve seat 14, and a stem tip end 22.

A spring retainer 30 is secured to stem 18 against axial and rotatable movement relative thereto by a lock member 32 in a known manner. A rotator mechanism B is provided for imparting rotary movement to valve A during axial movement thereof in a direction to move head 20 away from valve seat 14. Mechanism B includes upper and lower housing parts 34 and 36 movable axially and rotatably relative to one another about longitudinal axis 19.

A coiled valve spring 40 is positioned between spring retainer 30 and upper housing part 34 to bias the valve head 20 in a direction toward the seat 14. When the valve A is in the closed position of FIG. 1, the valve spring 40 is expanded and exerts a first force urging the head 20 of valve A toward seat 14. During operation of the engine, a rocker arm 44 applies a force to a valve stem tip end 22 to move valve head 20 away from valve seat 14 to a maximum open position. When the valve A is in the open position, a valve spring 40 is axially compressed from the open position of FIG. 1. The biasing force applied to the valve A by the spring 40 urging the valve toward the closed position increases as the valve moves from the closed position of FIG. 1 to a fully open position. Therefore, the force applied against the rotator mechanism B by the valve spring 40 is substantially greater when the valve A is in the open position than when the valve is in the closed position.

Figure 2:
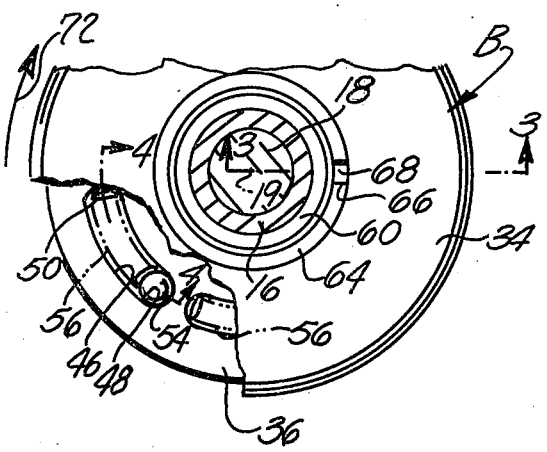
FIG. 2 is a cross-sectional plan view looking generally in the direction of arrows 2—2 of FIG. 1, and with certain portions eliminated and with other portions cut away for clarity of illustration.
Figure 3:
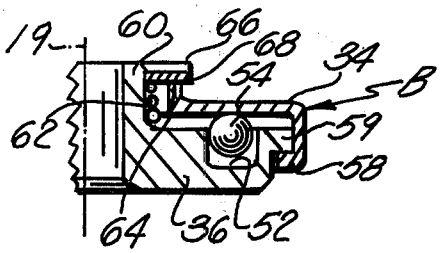
FIG. 3 is a cross-sectional elevational view looking generally in the direction of arrows 3—3 of FIG. 2.
Figure 4:
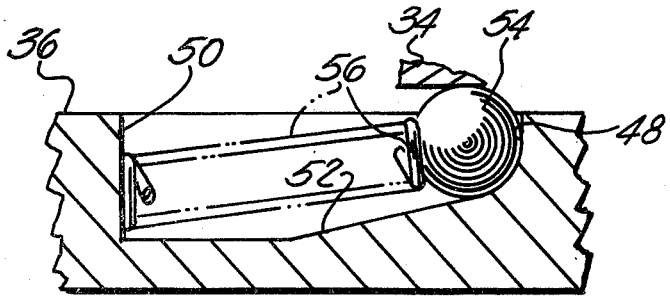
FIG. 4 is a cross-sectional elevational view looking generally in the direction of arrows 4—4 of FIG. 2.

As shown in FIGS. 2–4, the lower housing part 36 of the rotator mechanism B is formed with a plurality of elongated circumferentially-spaced arcuate grooves 46. The grooves 46 have a common circular longitudinal axis with its center at the axis 19. Each groove 46 has opposite end walls 48 and 50, and a ramp or bottom wall 52 which slopes downwardly from a shallow end portion adjacent the end wall 48 toward a deep end portion adjacent the end wall 50.

Each groove 46 receives a spherical ball 54 which forms a shiftable means or shiftable element. The depth of the shallow end portion of the groove adjacent the end wall 48 is substantially less than the diameter of ball 54. However, the deep end portion of the groove 46 adjacent the end wall 50 has a depth which is greater than the diameter of the ball 54. Yieldable coil-type biasing springs 56 are positioned in grooves 46 and urge the balls 54 up the ramp 52 toward the shallow end portions 48 of the grooves 46.

The housing parts 34 and 36 are adapted to move axially and rotatably relative to one another along and about longitudinal axis 19. Valve spring 40 normally urges rotator mechanism B along guide sleeve 16 so that the lower housing part 36 engages the outer surface of the engine head 10 with sufficient normal force to prevent rotation of the lower housing part relative to the engine head. The valve spring 40 engages spring retainer 30 and upper housing part 34 with sufficient normal force that the friction therebetween prevents relative rotation between the upper housing part 34, spring 40 and spring retainer 30 which is fixedly connected to the valve stem 18. If desired, the lower housing part 36 can be positively fixed to head 10 or sleeve 16, and valve spring 40 can be positively fixed to the upper housing part 34 and spring retainer 30. If desired, the valve rotator B could be located between the upper end of the valve spring 40 and the spring retainer 30.

The upper housing part 34 is flared inwardly as at 58 to cooperate with an outwardly extending rim portion 59 on the lower housing part 36 to prevent complete axial separation of such parts while permitting free relative rotation therebetween. The lower housing part 36 has a cylindrical hub portion 60 around which a coiled clutch spring 62 is positioned in light frictional engagement therewith. The upper housing part 34 also has a cylindrical hub portion 64 having a notch 66 therein receiving an outwardly bent terminal end portion 68 of clutch spring 62.

During operation of rotator B to impart rotation to valve A, the upper housing part 34 rotates in the direction of arrow 72 in FIG. 2 relative to the lower housing part 36. Clutch spring 62 is coiled in a direction around hub 60 of the lower housing part 36 so that cooperation between notch 66 and spring end portion 68, when the upper housing part 34 rotates in the direction of arrow 72, causes uncoiling and enlargement of the spring coils. This allows spring 62 to rotate freely with upper housing part 34 relative to hub 60 in the direction of arrow 72 in FIG. 2. When upper housing part 34 tends to rotate in a direction opposite to direction 72, cooperation between notch 66 and spring end portion 68 causes tightening of the spring coils and a slight reduction in their diameter so they tightly grip the hub portion 60 of lower housing part 36 and prevent reverse rotation of upper housing part 34 and valve A.

When valve A is closed, the housing parts 34 and 36 are axially separated from one another as shown in FIG. 3 and balls 54 are at the shallow end portions of grooves 46. At this time, the valve spring 40 is applying a first force which may also be called a valve closed force tending to move upper housing part 34 toward the lower housing part 36. As rocker arm 44 operates to open valve A, the valve spring 40 is compressed and exerts increasing force which reaches a maximum when valve A is fully open. This maximum force may be referred to as a second force or a valve open force. In other words, the valve spring 40 is a variable force applying means for applying forces which alternately increase and decrease between minimum and maximum values as valve A reciprocates between its closed and open positions. As the force of valve spring 40 increases, the balls 54 begin to roll down ramps 52 so that the upper housing part 34 moves toward the lower housing part 36. As this occurs, rotational movement is imparted to upper housing part 34 relative to the lower housing part 36 in the direction of arrow 72 by rolling engagement of the outer surfaces of the balls 54 with the upper housing part 34.

As valve A again moves toward its closed position, the force of valve spring 40 decreases so that balls 54 again move up ramps 52 under the influence of ball springs 56. In accordance with one feature of the present invention, ball springs 56 are designed to provide sufficient force to separate the housing parts 34 and 36 against the valve closed biasing force of valve spring 40. The separating of the housing parts 34 and 36 under the influence of the springs 56 tends to close the valve A since the rotator B is disposed between the retainer 30 on the valve stem 18 and the engine head 10. However the biasing force applied against the balls 54 by the springs is insufficient to separate the housing parts 34 and 36 against the influence of the relatively large force applied to the valve rotator B when the valve A is in the open position.

It should be noted that the balls 54 and ball springs 56 form a combined device which performs the dual functions of imparting rotation to the housing part 34 relative to the housing part 36 and axially separating such parts with a third force having a magnitude sufficient to overcome the influence of the valve spring 40 when the valve A is closed. This eliminates the need for a separate load bearing belleville spring washer to hold the housing parts 34 and 36 axially spaced apart when the valve A is closed. Since the springs 56 are ineffective to overcome the increased force of the valve spring 40 as the valve A opens, the springs enable the balls 54 to roll along the ramps 52 and rotate both the upper housing part 34 and valve A as the valve opens.

As shown in FIG. 5, each spring 56 exerts a force P on each ball 54. This force urges the associated ball 54 up its ramp 52 against the influence of the force F applied to the rotator B by the valve spring 40. A normal downward force N is produced between each ball 54 and each ramp 52. The angle between the horizontal and ramp 52 is generally indicated by numeral 80 in FIG. 5. The force diagram constructed from these forces is shown in FIG. 6. It should be noted that when the valve A is in the closed position, the force F applied by the valve spring 40 is insufficient to overcome the influence of the rotator spring forces P and the normal forces N so that the ball 52 is moved to the shallow end of the ramp 52 and the housing parts 34 and 36 are separated as shown in FIG. 4. As the valve A is opened, the valve spring force F increases sufficiently to overcome the influence of the rotator spring forces P and the balls 54 roll down the ramp 52. The design formula for each ball or rotor spring is as follows:

$$P = \frac{fGd^4}{8D^3\,(Nu)}$$

In the formula, P is the force applied by a spring 56; $f$ is the spring deflection; G is the torsional modulus; $d$ is wire diameter; D is the mean diameter; and Nu is the number of spring coils. In the valve closed position, the total force acting on part 34 tending to separate it from the part 36 results from the total force P produced by all of springs 56 acting on all of balls 54. This total separating force is sufficient to overcome the first or valve closed force F produced by valve spring 40 acting on part 34 so that parts 34 and 36 will be axially separated from one another as shown in FIG. 3 when the valve A is closed. At this time, the entire thrust load of valve spring 40 is taken by all of balls 54. As valve A starts to open by action of rocker arm 44, the force applied by valve spring 40 increases so the balls 54 begin to roll down ramps 52 until they are at or near the bottom of their respective ramps 52. During this operation, the rolling reaction of balls 54 against part 34 causes rotation of part 34 relative to part 36 to thereby rotate the valve A.

As valve A begins to close, the action is reversed with the force of valve spring 40 diminishing so that the force of each ball spring 56 begins to push its respective ball 54 up its associated ramp 52. At this time, reverse relative rotation tends to occur between parts 34 and 36. However, in view of the fact that balls 54 now tend to roll in an opposite direction, the clutch spring 62 is engaged to prevent reverse relative rotation. Therefore, ball springs 56 cause sliding of each ball 54 up its associated ramp 52 rather than rolling. The resulting is such that there is no reverse valve rotation. This action continues until the valve closed position is reached and the balls are pushed to the top of each ramp, thus completing the valve rotational cycle.

In the rotator of the present application, the separating force produced by springs 56 tending to axially separate parts 34 and 36 during relative rotation therebetween must be of a value sufficient to overcome the valve closed force produced by valve spring 40 and insufficient to overcome the valve open force produced by the compressed spring 40. This is accomplished with reference to FIGS. 5 and 6 as follows:

$$\frac{P}{F} = \text{Sine of angle 80}$$

The valve housing parts 34 and 36 must move together as the valve A opens in order to effect rotation of the valve. Therefore as the valve A opens, the sine of the angle 80 times the valve force F produced by valve spring 40 increases to a total force which is greater than the total force P of FIG. 5 produced by all of springs 56 acting on all of balls 54. Since the valve housing parts 34 and 36 must move apart as the valve A closes in order to set the rotator B for the next operating cycle, the sine of the angle 80 times the valve force F of the spring 40 decreases to a total force which is less than the total force P produced by all of the springs 56 acting on the balls 54. In general, it may be said that the separating force resulting from the ball springs 56 acting on the balls 54 is intermediate the minimum or valve closed and the maximum or valve open forces produced by valve spring 40.

Upon opening of the valve A, F times the sine of angle 80 is greater than P and the balls 54 will roll down the ramps 52. As this occurs, the rotation of the outer surfaces of the balls 54 will rotate the upper housing part 34 and valve A about the axis 19. Upon closing of the valve A, F times the sine of angle 80 is less than P. At this time, the action of the spring clutch 62 will hold the housing part 34 against rotation and the balls 54 will slide up the ramps 52 without counter-rotation of the valve A about the axis 19. As the balls 54 slide up the ramps 52, the housing parts 34 and 36 are moved axially apart in the direction of valve closing. Thus, the upper housing part 34 is moved upwardly away from the lower housing part 36 as the valve head 20 moves upwardly toward the valve seat 14.

FIGS. 7 and 8 show other rotation inhibiting means instead of spring clutch 62 of FIG. 3. In the arrangement of FIG. 7, a belleville spring 90 is interposed between parts 34 and 36 to provide a frictional drag therebetween which is easily overcome by the greater rotation producing force when balls 54 roll down ramps 52 but which inhibits reverse rotation to provide ball sliding as the balls move up the ramps and the force of valve spring 40 is diminishing. In this arrangement, it should be noted that belleville spring washer 90 is of extremely light construction so that the force it produces is insignificant insofar as separation of parts 34 and 36 is concerned. Such a spring washer is provided only to produce frictional resistance against reverse relative rotation between parts 34 and 36, and is not a load carrying member. In FIG. 8, a wave washer 92 is provided to produce frictional resistance against relative rotation between parts 34 and 36 for preventing reverse rotation thereof.

FIG. 9 shows another arrangement wherein part 36 is formed with a circumferential groove 98 receiving a coiled spring 102 having a coil diameter greater than the depth of groove 98. In an arrangement of this type, the coils of the spring 102 are normally slanted slightly in one direction which corresponds to the desirable rotational direction of part 34 relative to part 36. In previous arrangements of this type, a belleville spring washer has been used to provide the separating force between parts 34 and 36 to overcome the valve closed force of valve spring 40. In the arrangement of FIG. 9, spring 102 is designed so its reaction force is intermediate the valve closed and the valve open forces produced by valve spring 40. Thus, the reaction force of the spring alone produces the separating force for separating parts 34 and 36 against the valve closed force of valve spring 40. As valve A begins to open and the force produced by valve spring 40 increases toward its maximum valve open force, the coils of spring 102 move further from their position slightly inclined to the vertical toward a more horizontal position so that part 34 rotates relative to part 36. As the valve begins to close and the force of valve spring 40 is diminishing, the reaction force of spring 102 again begins to separate parts 34 and 36, while reverse rotation therebetween is inhibited by clutch spring 62.

Although the invention has been shown and described with respect to certain preferred arrangements, it is obvious that equivalent alterations and modifications will occur to others skilled in the art upon the reading and understanding of this specification. The present invention includes all such equivalent alterations and modifications, and is limited only by the scope of the claims.

Having described specific preferred embodiments of the invention, the following is claimed:

1. A valve rotator comprising first and second parts movable relative to one another rotatably and axially, variable force applying means for applying a first and second force in a predetermined direction to move said parts toward one another, said second force having a magnitude substantially greater than the first force, shiftable elements positioned between said parts and engaged therewith and movable to relatively rotate said parts in response to axial movement of said parts toward each other, spring means acting on said shiftable elements and biasing the elements against movement due to axial movement of the parts toward each other, said spring means comprising means for applying a separating force through said shiftable elements to said parts which separating force is of a magnitude intermediate said first and second forces to move said parts axially away from one another, and rotation inhibiting means engagingly coacting between said parts and being completely separate from said spring means and said shiftable elements for inhibiting relative rotation between said parts in a direction opposite to said predetermined direction, said rotation inhibiting means being substantially ineffective to inhibit rotation between the parts in said predetermined direction.

2. The valve rotator of claim 1 wherein said rotation inhibiting means comprising a friction spring positioned between and frictionally engaging said parts.

3. The valve rotator of claim 1 wherein one of said parts includes a hub and said rotation inhibiting means comprises a coiled spring clutch received on said hub and having a spring clutch end attached to the other of said parts, said spring clutch being positioned for radial enlargement thereof for providing free rotation between said clutch spring and hub during relative rotation between said parts in said predetermined direction and for radial reduction for tightening on said hub when said parts tend to rotate relative to one another in a direction opposite to said predetermined direction.

4. The valve rotator of claim 1 wherein said shiftable elements comprise a plurality of balls positioned on ramps between said parts, said ramps sloping downwardly from first ramp ends toward second ramp ends, said balls having a diameter for holding said parts separated from one another when said balls are positioned on said first ramp ends, said balls rolling along said ramps from said first ramp ends toward said second ramp ends to impart relative rotation between said parts as said parts move toward one another, and ball springs positioned for biasing said balls in a direction from said second ramp ends toward said first ramp ends for applying said separating force.

5. A valve system for an internal combustion engine comprising a valve having a head and a stem, a valve seat coacting with said valve head, and a valve rotator coaxially mounted with respect to said valve stem, said valve being reciprocable along its stem axis toward and away from said seat and rotatable about said axis, said valve rotator comprising first and second parts movable relative to one another rotatably and axially, said first part being mounted for imparting rotational movement to said valve during movement of the valve away from said seat, variable force applying means acting to urge said valve against said seat and for applying a first and second force in a predetermined direction to move said parts toward one another, said second force having a magnitude substantially greater than the first force, shiftable elements positioned between said parts and engaged therewith and movable to relatively rotate said parts in response to the axial movement of said parts toward each other, spring means acting on said shiftable elements and biasing the elements against movement due to axial movement of the parts toward each other, said spring means comprising means for applying a separating force through said shiftable elements to said parts which separating force is of a magnitude intermediate said first and second forces to move said parts axially away from one another, and rotation inhibiting means engagingly coacting between said parts and being completely separate from said spring means and said shiftable elements for inhibiting relative rotation between said parts in a direction opposite to said predetermined direction, said rotation inhibiting means being substantially ineffective to inhibit rotation between the parts in said predetermined direction.

6. The mechanism of claim 5 wherein said shiftable elements comprise balls positioned in grooves in one of said parts facing toward the other of said parts, said grooves having sloping bottoms which slope downwardly from shallow ends having a depth substantially less than the diameter of said balls toward deeper ends, said yieldable biasing means comprising ball springs normally biasing said balls toward said shallow ends, said balls rolling along said groove bottoms from said shallow ends toward said deeper ends to impart relative rotation between said parts during movement of said parts toward one another as said first force increases toward said second force, and said balls moving in a direction from said deeper ends toward said shallow ends under influence of said ball springs as said second force decreases toward said first force.

* * * * *